US006315278B1

(12) United States Patent
Gaztanaga

(10) Patent No.: US 6,315,278 B1
(45) Date of Patent: Nov. 13, 2001

(54) COMPACT CLAMP

(75) Inventor: Jose Antonio Iriondo Gaztanaga, Guipuzcoa (ES)

(73) Assignee: Grip-on Tools, S.A., Berriz (ES)

( * ) Notice: Subject to any disclaimer, the term of this patent is extended or adjusted under 35 U.S.C. 154(b) by 0 days.

(21) Appl. No.: 09/502,151

(22) Filed: Feb. 11, 2000

(30) Foreign Application Priority Data

Jan. 14, 2000 (ES) ..... 9900591

(51) Int. Cl.[7] ..... B25B 1/14
(52) U.S. Cl. ..... 269/228
(58) Field of Search ..... 269/249, 228, 269/91, 94, 201; 74/106; 439/803

(56) References Cited

U.S. PATENT DOCUMENTS

| | | | | |
|---|---|---|---|---|
| 809,882 | | 1/1906 | Wrigley . | |
| 2,103,074 | | 12/1937 | Gardner . | |
| 2,126,767 | | 8/1938 | Gibbons . | |
| 2,327,368 | | 8/1943 | Olson . | |
| 2,379,107 | | 6/1945 | Scheck . | |
| 2,453,041 | | 11/1948 | Sharp . | |
| 2,462,709 | | 2/1949 | Ball . | |
| 2,466,937 | | 4/1949 | Downs . | |
| 2,501,238 | | 3/1950 | Sarsgard et al. . | |
| 2,544,329 | | 3/1951 | Kirk . | |
| 2,549,256 | | 4/1951 | Sparling . | |
| 2,610,662 | | 9/1952 | Ratcliff . | |
| 2,651,959 | | 9/1953 | Harrington . | |
| 2,855,964 | | 10/1958 | Zelazny . | |
| 2,937,677 | | 5/1960 | McIlwain . | |
| 3,170,214 | | 2/1965 | Cochrane . | |
| 3,425,098 | | 2/1969 | Bredvik . | |
| 3,872,760 | | 3/1975 | Desnoyers, Jr. . | |
| 3,912,251 | * | 10/1975 | Fraser et al. | 269/228 |
| 3,984,092 | | 10/1976 | Fitzpatrick . | |
| 4,083,624 | * | 4/1978 | Timmer | 269/249 |
| 4,108,589 | * | 8/1978 | Bunch | 269/228 |
| 4,141,543 | * | 2/1979 | Kato | 269/228 |
| 4,673,174 | * | 6/1987 | Tabbert | 269/228 |
| 5,373,642 | * | 12/1994 | Supe-Dienes | 269/228 |
| 5,718,419 | | 2/1998 | Hall . | |
| 5,772,193 | * | 6/1998 | Dykstra | 269/228 |

* cited by examiner

*Primary Examiner*—Robert C. Watson
(74) *Attorney, Agent, or Firm*—Seyfarth Shaw

(57) ABSTRACT

A compact toggle clamp has a frame defining a fixed jaw at one end and a bore adjacent to the other end in which is received a movable jaw assembly, including an internally threaded cylinder and a screw threadedly engaged in one end thereof and having an enlarge jaw head facing the fixed jaw. The movable jaw assembly moves between clamping and unclamping positions relative to the fixed jaw, being biased toward the unclamping position by a helical compression spring in the bore. Clamping of the movable jaw is effected by a lever mechanism including a clamp lever pivoted to the frame at a first pivot and coupled to the rear end of the cylinder by a link pivoted to the clamp lever at a second pivot and to the cylinder at a third pivot so that, in the clamping position, the three pivots are all substantially aligned along the axis of the cylinder. A release lever facilitates movement of the clamp lever from its clamping condition. The movable jaw assembly is always disposed between the fixed jaw and the first pivot and the lever mechanism does not move substantially beyond the end of the frame.

19 Claims, 2 Drawing Sheets

COMPACT CLAMP

BACKGROUND OF THE INVENTION

The present invention relates to clamp-type hand tools for holding one or more parts, and particularly to clamps of the toggle type.

Various types of clamping tools are well known in the art, and typically they include a fixed arm carrying a fixed jaw and a movable arm carrying a movable jaw, the jaws cooperating to hold a part firmly therebetween. One type of clamping tool is of the pliers or pivoting-jaw type, wherein the movable arm and jaw are pivotally movable relative to the fixed arm or jaw. Another type of clamping tool is a linear clamp, wherein the movable arm and jaw reciprocate along a linear path toward and away from the fixed jaw.

The present invention relates to the latter type of clamping tool. Heretofore, clamping tools of the linear type have been characterized by relatively large and unwieldy construction, which may make it difficult for them to be used in many confined-space applications. For example, many clamps have frames or fixed arm members which project a substantial distance in directions perpendicular to the direction of movement of the movable jaw. Also, such prior clamps typically have adjusting mechanisms for adjusting the distance between the fixed and movable jaws in the clamped condition, and this adjustment is typically accomplished by a screw mechanism which extends variable distances beyond the end of the frame.

Many such prior art clamp tools use a toggle or over-center mechanism for moving the movable jaw to and from and retaining it in its clamped position, and such toggle mechanisms are typically relatively complicated and/or can considerably extend the operating profile of the tool.

SUMMARY OF THE INVENTION

It is a general object of the invention to provide an improved clamp which avoids the disadvantages of prior clamps while affording additional structural and operating advantages.

An important feature of the invention is the provision of a clamp of the type with a linearly movable jaw which has a compact, small profile.

In connection with the foregoing feature, another feature of the invention is the provision of a clamp of the type set forth, which can be adjusted without affecting the profile and can be moved between clamped and unclamped conditions substantially without extending the length of the tool.

Still another feature of the invention is the provision of a clamp of the type set forth, which is of simple and economical construction.

Certain ones of these and other features of the invention may be attained by providing a compact clamp comprising: a frame defining a fixed jaw, a clamp lever mechanism pivotally connected to the frame adjacent to an end of the frame, and a movable jaw assembly disposed between said fixed jaw and the end and carried by the frame for linear movement toward and away from the fixed jaw, the clamp lever mechanism being coupled to the movable jaw assembly for effecting movement thereof.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DESCRIPTION OF THE PREFERRED EMBODIMENT

Figure 1:
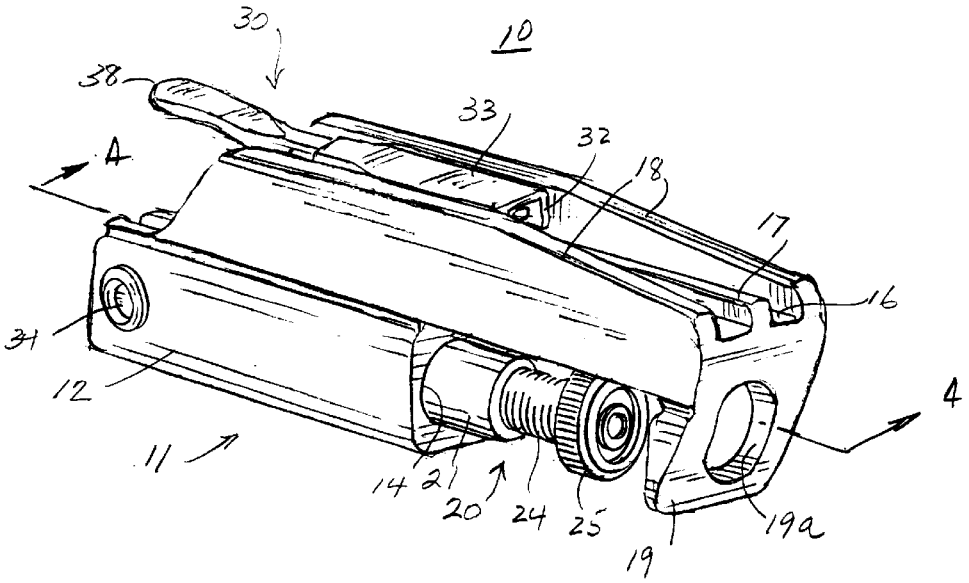
FIG. 1 is a perspective view of a clamp constructed in accordance with the present invention and shown in its clamping condition.

Referring to FIGS. 1–4, there is illustrated a clamp, generally designated by the numeral 10, constructed in accordance with the present invention. The clamp 10 has a frame or fixed arm 11 of unitary, one-piece construction, preferably formed of a suitable metal, such as an aluminum alloy. The frame 11 includes a body 12 which has an open-top, generally channel-shaped rear end 13 and is provided at its forward end with a cylindrical bore 14 having a slightly larger-diameter counterbore 15. The frame 11 has a generally rectangular top wall 16 which projects forwardly of the body 12 and is provided longitudinally centrally thereof with an upstanding center rib 17 and is integral at its side edges with a pair of upstanding side flanges 18. Integral with the top wall 16 at its forward end and depending therefrom is a fixed jaw 19, having formed therethrough a circular hole 19*a* coaxial with the bore 14 along an axis X.

The clamp 10 has a movable jaw assembly 20, including a cylinder or movable arm 21 disposed in the bore 14 for movement coaxially thereof. The cylinder 21 is integral at its rear end with an enlarged-diameter, bifurcated ram 22 dimensioned to fit slidably within the counterbore 15 and defining an annular shoulder 23. The cylinder 21 is internally threaded and threadedly receives in its forward end a screw 24 having an enlarged-diameter head or movable jaw 25. A helical compression spring 26 is disposed in the counterbore 15 coaxially surrounding the cylinder 21 and trapped between the shoulder 23 and the front end of the counterbore 15 for resiliently urging the cylinder 21 rearwardly away from the fixed jaw 19.

The clamp 10 also has a lever mechanism 30 including a clamp lever 31 which has a generally dog-leg shape and includes a pair of parallel side plates 32, the forward portions of which are joined by a top wall 33. One end of the clamp lever 31 is received in the channel-shaped rear end 13 of the body 12 and is pivotally coupled thereto by a pivot pin 34 extending through complementary openings in the clamp lever 31 and the body 12. The clamp lever 31 is coupled to the cylinder 31 by a link 35, one end of which is disposed between the side plates 32 of the clamp lever 31 and is pivotally coupled thereto by a pivot pin 36, and the other end of which is disposed in the bifurcated rear end 22 of the cylinder 21 and is pivotally coupled thereto by a pivot pin 37. A elongated release lever 38 is disposed between the side plates 32 beneath the top wall 33. The release lever 38 is pivotally coupled to the clamp lever 31 by a pivot pin 39 extending between the side plates 32 at their forward ends, the rear end of the release lever 38 projecting rearwardly beyond the top wall 33 of the clamp lever 31 a predetermined distance for easy access by a user.

Figure 2:
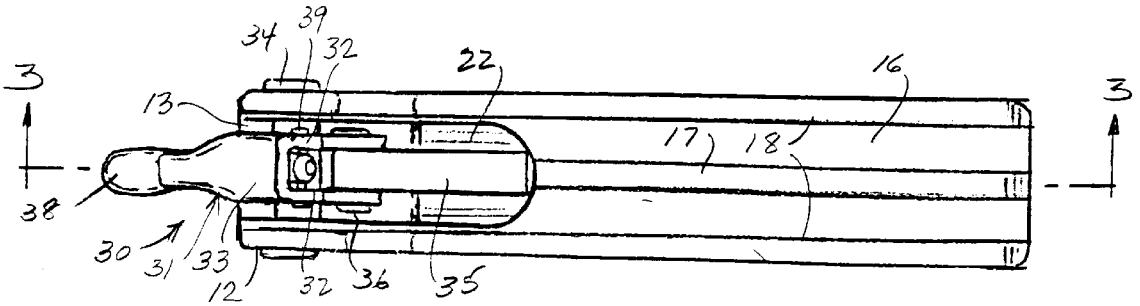
FIG. 2 is a top plan view of the clamp of FIG. 1, shown in its unclamped condition.
Figure 3:
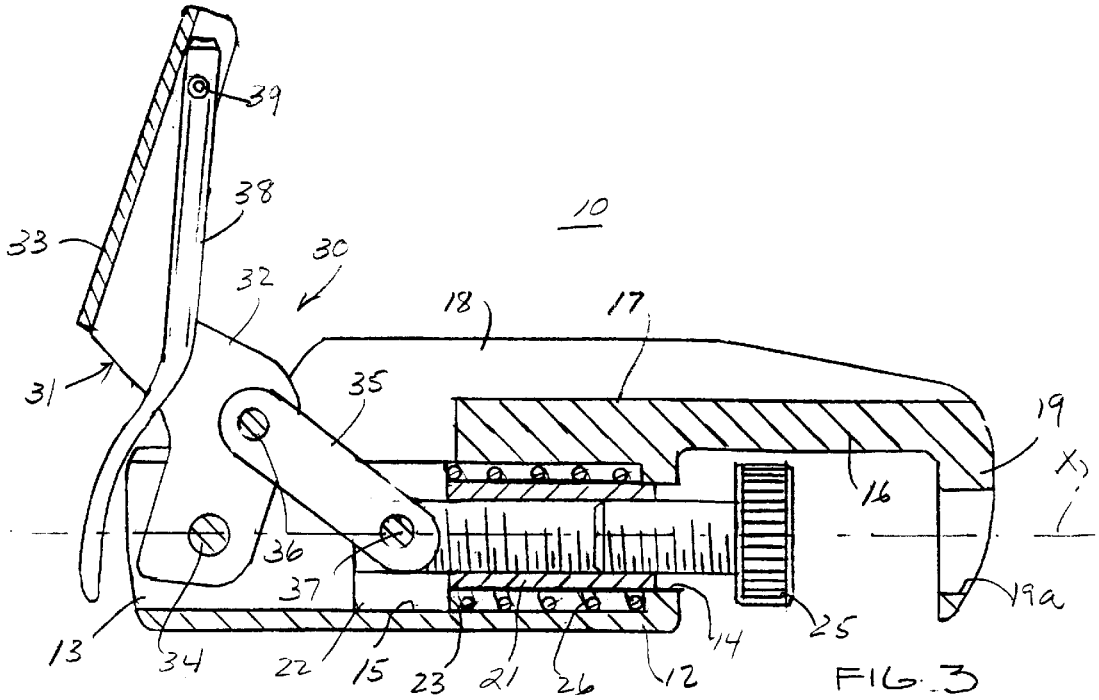
FIG. 3 is an enlarged, sectional view taken generally along the line 3—3 in FIG. 2 and illustrating a second adjustment position of the movable jaw in phantom.
Figure 4:
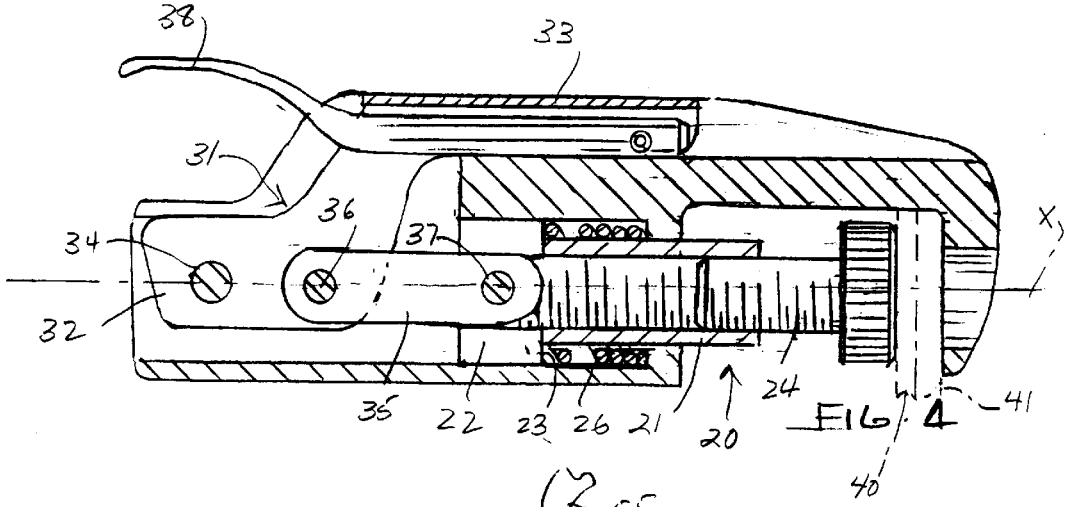
FIG. 4 is a view similar to FIG. 3, illustrating the clamp in its clamping condition.

In operation, the lever mechanism 30 is moved between a clamping condition illustrated in FIGS. 1 and 4 and a release condition illustrated in FIGS. 2 and 3, for moving the movable jaw assembly 20 between a clamping position, illustrated in FIG. 1 and an unclamped position illustrated in FIG. 2. More specifically, when the lever mechanism 30 is in its release condition, the items to be clamped, such as workpieces 40 and 41 (FIG. 4) are disposed between the fixed and movable jaws 19 and 25. The clamp lever 31 is then pivoted in a clockwise direction, as viewed in FIG. 3, about the axis of the pivot pin 34 to the clamping condition of FIG. 4, wherein the upper ends of the side plates 32 are seated between the side flanges 18 of the frame 11 so that the top wall 33 of the clamp lever 31 does not project substantially thereabove, thereby providing a very low-profile arrangement. During this movement, the pivot pin 36 is driven downwardly, as viewed in FIG. 3, driving the cylinder 21 forwardly and moving the movable jaw 25 into engagement with the workpiece 41 for cooperation with the fixed jaw 19 to clamp the workpieces 40 and 41 therebetween. It can be seen that, when the lever mechanism 30 has reached its clamping condition, the axes of the pivot pins 34, 36 and 37 are disposed substantially in alignment along the axis X (FIG. 4), in a dead center position. If desired, the parts could be arranged so that, in this clamping condition, the axis of the pivot pin 36 is disposed slightly below the axis X in an over-center position to more stably retain the clamp in its clamping condition. It will further be appreciated that, during this clamping movement, the movable jaw 25 is moved forwardly against the urging of the spring 26, which becomes compressed, as seen in FIG. 4.

In order to release the workpieces 40 and 41, the clamp lever 31 is pivoted back counterclockwise about the axis of the pivot pin 34. Since the upper end of the clamp lever 31 is nested between the side flanges 18, this releasing movement is facilitated by the release lever 38. More specifically, the exposed rear end of the release lever 38 is depressed by the user, causing it to engage the rear end of the frame center rib 17, which acts as a fulcrum. Thus, continued depression of the release lever 38 will, by lever action, drive the front end of the clamp lever 31 upwardly, as illustrated in the broken lines in FIG. 4, pulling the pivot pin 36 upwardly. Once the axis of the pivot pin 36 is moved above the axis X, the spring 26 will take over and drive the movable jaw assembly 20 and the lever mechanism 30 back to the position illustrated in FIG. 3. It can be seen that the lever mechanism 30, even in the release condition, extends only a slight distance beyond the rear end of the frame 11, so that the clamp 10 can be operated without significantly altering the length thereof.

It will be appreciated that the movable jaw 20 is adjustable for different thickness of clamped workpieces by screwing the screw 24 into and out of the cylinder 21. This adjustment does not in any way affect the overall length of the clamp 10.

Figure 5:
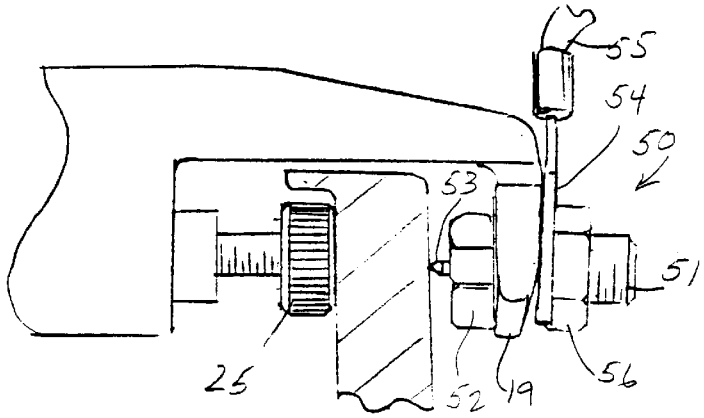
FIG. 5 is a reduced, fragmentary view similar to FIG. 4 of the clamp of FIG. 1 with an electrical conductor attachment.

Referring to FIG. 5, there is illustrated an attachment assembly 50 for use in connecting an electrical conductor, such as a ground wire, to the clamp 10. More specifically, the attachment assembly 50 includes a screw 51 having a shank which extends forwardly through the hole 19*a* in the fixed jaw 19, the screw 51 having a head 52 with an axially projecting pin 53. A terminal loop 54 of a insulated conductor 55 may be received over the shank of the screw 51, which shank is threadedly engaged with a nut 56 for drawing the screw head 52 snugly against the rear face of the fixed jaw 19 and firmly clamping the terminal loop 54 against the front face of the fixed jaw 19 to provide a good electrical contact. This arrangement may be useful for connecting ground wires or the like in the clamping of parts for electric welding of coated panels.

In a constructional model of the invention, the movable jaw assembly 20 may be formed of a suitable metal, such as brass, and the parts of the lever mechanism 30 may be formed of suitable metals, such as suitable steels.

From the foregoing, it can be seen that there has been provided an improved clamp which has very small dimensions and proportions in all operating positions and which can be operated without appreciably changing the overall length of the clamp.

While a particular embodiment of the present invention has been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

I claim:

1. A compact hand-held clamp comprising:

a one-piece frame defining a fixed jaw, a clamp lever mechanism pivotally connected to said frame adjacent to an end of the frame, and a movable jaw assembly disposed between said fixed jaw and said end and carried by said frame for linear movement toward and away from the fixed jaw, said clamp lever mechanism being coupled to said movable jaw assembly for effecting movement thereof, said movable jaw assembly including a bias spring coupled to said frame for assisting movement of said movable jaw assembly away from the fixed jaw.

2. The clamp of claim 1, wherein said frame defines a bore, said movable jaw assembly including a cylinder movable within said bore coaxially therewith.

3. The clamp of claim 1, wherein said clamp lever mechanism includes a clamp lever member pivotally coupled to the frame at a first pivot, and a link pivotally coupled to the clamp lever at a second pivot and to the movable jaw assembly at a third pivot.

4. The clamp of claim 3, wherein said movable jaw assembly is movable between clamping and unclamping positions relative to the fixed jaw, said lever mechanism being movable between clamping and release conditions corresponding to said clamping and unclamping positions, said lever mechanism including a release lever coupled to said clamp lever for facilitating movement of said lever mechanism from the clamping condition.

5. The clamp of claim 4, wherein said release lever is pivotally coupled to said clamp lever and engageable with said frame when said lever mechanism is in its clamping condition, whereby said frame acts as a fulcrum for said release lever.

6. The clamp of claim 3, wherein said movable jaw assembly is movable along an axis, said first and second and third pivots being disposed substantially in alignment along said axis in the clamping condition of said lever mechanism, and said second pivot being disposed out of alignment with said first and third pivots in the release condition of the lever mechanism.

7. The clamp of claim 1, wherein said frame defines a bore, said movable jaw assembly including a cylinder disposed in said bore for movement coaxially thereof and having an annular radially outwardly projecting shoulder thereon, said spring comprising a helical compression spring disposed coaxially around said cylinder and engageable with said shoulder and with said frame at an end of said bore.

8. The clamp of claim 1, wherein said lever mechanism does not extend substantially beyond said end.

9. The clamp of claim 1, and further comprising an attachment adapted to be coupled to said fixed jaw for connecting an electrical conductor thereto.

10. A compact hand-held clamp comprising:

an elongated one-piece frame having first and second ends and defining a fixed jaw, a movable jaw assembly disposed entirely between said ends and carried by said frame for linear movement longitudinally of the frame toward and away from the fixed jaw, and a clamp lever mechanism coupled between the frame and the movable jaw assembly for effecting linear movement of the movable jaw assembly between clamping and unclamping positions relative to the fixed jaw, said movable jaw assembly including a bias spring coupled to said frame for assisting movement of said movable jaw assembly from its clamping position, said movable jaw assembly including adjustment mechanism movable for adjusting the distance between the fixed and movable jaws in the clamping position without extending beyond said ends.

11. The clamp of claim 10, wherein said adjustment mechanism includes a screw-threaded mechanism.

12. The clamp of claim 11, wherein said movable jaw assembly includes an internally threaded cylinder, said adjustment mechanism including a screw threadedly engaged in an end of said cylinder.

13. The clamp of claim 10, wherein said clamp lever mechanism includes a clamp lever member pivotally coupled to the frame at a first pivot, and a link pivotally coupled to the clamp lever at a second pivot and to the movable jaw assembly at a third pivot.

14. The clamp of claim 13, wherein said movable jaw assembly is movable along an axis, said first and second and third pivots being disposed substantially in alignment along said axis in the clamping condition of said lever mechanism, and said second pivot being disposed out of alignment with said first and third pivots in the release condition of the lever mechanism.

15. The clamp of claim 13, wherein said movable jaw assembly is movable between clamping and unclamping positions relative to the fixed jaw, said lever mechanism being movable between clamping and release conditions corresponding to said clamping and unclamping positions, said lever mechanism including a release lever coupled to said clamp lever for facilitating movement of said lever mechanism from the clamping condition.

16. The clamp of 10, wherein said frame defines a bore, said movable jaw assembly including a cylinder disposed in said bore for movement coaxially thereof and having an annular radially outwardly projecting shoulder thereon, said spring comprising a helical compression spring disposed coaxially around said cylinder and engageable with said shoulder and with said frame at an end of said bore.

17. The clamp of claim 10, wherein said lever mechanism does not extend substantially beyond said end.

18. The clamp of claim 10, and further comprising an attachment adapted to be coupled to said fixed jaw for connecting an electrical conductor thereto.

19. A compact hand-held clamp comprising:

a one-piece frame defining a fixed jaw, a clamp lever mechanism pivotally connected to said frame adjacent to an end of the frame, and a movable jaw assembly disposed between said fixed jaw and said end and carried by said frame for linear movement toward and away from the fixed jaw, said clamp lever mechanism being coupled to said movable jaw assembly for effecting movement thereof, said movable jaw assembly including a bias spring coupled to said frame for assisting movement of said movable jaw assembly away from the fixed jaw, the clamp lever mechanism including a clamp lever member pivotally coupled to the frame at a first pivot, and a link pivotally coupled to the clamp lever at a second pivot and to the movable jaw assembly at a third pivot, the movable jaw assembly being movable between clamping and unclamping positions relative to the fixed jaw, the lever mechanism being movable between clamping and release conditions corresponding to the clamping and unclamping positions, the lever mechanism including a release lever coupled to the clamp lever member for facilitating movement from the lever mechanism from the clamping condition, the release lever being pivotally coupled to the clamp lever member and engageable with the frame when the lever mechanism is in its clamping condition, whereby the frame acts as a fulcrum for the release lever.

* * * * *